US010304422B2

(12) United States Patent
Yaguchi et al.

(10) Patent No.: US 10,304,422 B2
(45) Date of Patent: May 28, 2019

(54) SUPPORT ASSEMBLY AND KEYBOARD APPARATUS

(71) Applicant: YAMAHA CORPORATION, Hamamatsu-shi (JP)

(72) Inventors: Nariyasu Yaguchi, Hamamatsu (JP); Akito Ohba, Hamamatsu (JP); Hiroshi Harimoto, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/712,292

(22) Filed: Sep. 22, 2017

(65) Prior Publication Data

US 2018/0012572 A1 Jan. 11, 2018

Related U.S. Application Data

(63) Continuation of application No. PCT/JP2016/057128, filed on Mar. 8, 2016.

(30) Foreign Application Priority Data

Mar. 25, 2015 (JP) ..... 2015-063228

(51) Int. Cl.
*G10C 3/16* (2019.01)
*G10H 1/34* (2006.01)
*G10C 3/22* (2019.01)

(52) U.S. Cl.
CPC ..... *G10C 3/16* (2013.01); *G10C 3/22* (2013.01); *G10H 1/34* (2013.01); *G10H 1/346* (2013.01); *G10H 2220/305* (2013.01)

(58) Field of Classification Search
CPC ... G10C 3/16; G10C 3/22; G10H 1/34; G10H 1/346; G10H 2220/305
See application file for complete search history.

(56) References Cited

U.S. PATENT DOCUMENTS 7,807,907 B2 * 10/2010 Inoue ..... G10C 3/22 84/234
2014/0020543 A1 * 1/2014 Oba ..... G10F 1/02 84/20

FOREIGN PATENT DOCUMENTS

| | | | |
|---|---|---|---|
| GB | 463714 | A | 4/1937 |
| JP | 49002327 | U1 | 1/1974 |
| JP | S5371429 | U | 6/1978 |
| JP | H0461396 | U | 5/1992 |
| JP | H0590571 | U | 12/1993 |
| JP | 2002202773 | A | 7/2002 |

(Continued)

OTHER PUBLICATIONS

International Search Report issued in Intl. Appln. No. PCT/JP2016/057125 dated May 24, 2016. English translation provided.

(Continued)

*Primary Examiner* — Kimberly R Lockett
(74) *Attorney, Agent, or Firm* — Rossi, Kimms & McDowell LLP

(57) ABSTRACT

A support assembly in one embodiment of the present invention includes a support rotatable along a first surface with respect to a frame; a repetition lever rotatable with respect to the support; and an extension portion coupled to the repetition lever, the extension portion being slidable contact with a first guide portion, the first guide portion moving along the first surface.

20 Claims, 14 Drawing Sheets

(56) References Cited

FOREIGN PATENT DOCUMENTS

| | | | |
|---|---|---|---|
| JP | 2003228367 | A | 8/2003 |
| JP | 2004252252 | A | 9/2004 |
| JP | 2004280065 | A | 10/2004 |
| JP | 2005292361 | A | 10/2005 |
| JP | 2006171617 | A | 6/2006 |

OTHER PUBLICATIONS

Written Opinion issued in Intl. Appln. No. PCT/JP2016/057125 dated May 24, 2016. English translation provided.
International Preliminary Report on Patentability issued in Intl. Appln. No. PCT/JP2016/057125 dated Sep. 26, 2017. English translation provided.
Copending U.S. Appl. No. 15/712,228, filed Sep. 22, 2017.
Copending U.S. Appl. No. 15/712,273, filed Sep. 22, 2017.
International Search Report issued in Intl. Appln. No. PCT/JP2016/057126 dated May 24, 2016. English translation provided.
Written Opinion issued in Intl. Appln. No. PCT/JP2016/057126 dated May 24, 2016. English translation provided.
International Preliminary Report on Patentability issued in Intl. Appln. No. PCT/JP2016/057126 dated Sep. 26, 2017. English translation provided.
Office Action issued in Japanese Appln. No. 2015-063268 dated Apr. 11, 2017. Partial English translation provided.
International Search Report issued in Intl. Appln. No. PCT/JP2016/057128 dated May 21, 2016. English translation provided.
Written Opinion issued in Intl. Appln. No. PCT/JP2016/057128 dated May 31, 2016. English translation provided.
International Preliminary Report on Patentability issued in Intl. Appln. No. PCT/JP2016/057128 dated Sep. 26, 2017. English translation provided.
Office Action issued in U.S. Appl. No. 15/712,228 dated Jul. 27, 2018.
Office Action issued in Japanese Appln. No. 2017-092821 dated Jul. 31, 2018. English translation provided.
Office Action issued in U.S. Appl. No. 15/712,273 dated Oct. 31, 2018.

* cited by examiner

SUPPORT ASSEMBLY AND KEYBOARD APPARATUS

This application is a U.S. continuation application filed under 35 U.S.C. § 111(a), of International Application No. PCT/JP2016/057128, filed on Mar. 8, 2016, which claims priority to Japanese Patent Application No. 2015-063228, filed on Mar. 25, 2015, the disclosures of which are incorporated by reference.

FIELD

The present invention relates to a support assembly used in a musical keyboard apparatus.

BACKGROUND

Conventional acoustic pianos such as a grand piano and an upright piano are configured by a great number of components. As the assembly of such components is very complex, the assembly work takes a long time. In particular, an action mechanism arranged in correspondence with each key requires many components, and hence the assembly work thereof is very complex.

For example, in an action mechanism described in Japanese Unexamined Patent Publication no. 2005-292361, a plurality of components operate together and the movement of the key by key depression and key release is transmitted to a hammer. In particular, in a support assembly configuring one part of the action mechanism, various components operate in combination. The support assembly includes not only a mechanism for realizing string hitting by the hammer according to the key depression, but also an escapement mechanism for releasing the force transmitted to the hammer by the operation of the key immediately before the string hitting. This mechanism is an important mechanism for realizing the basic operation of the acoustic piano. In particular, in the grand piano, a double escapement mechanism in which a repetition lever and a jack are combined is generally adopted.

The operation of the action mechanism provides a feeling (hereinafter referred to as "touch feeling") to the finger of the player through the keys. In particular, the configuration of the support assembly greatly influences the touch feeling. For example, the touch feeling by the operation of the escapement mechanism is called "let-off".

SUMMARY

A support assembly according to one embodiment of the present invention includes a support rotatable along a first surface with respect to a frame; a repetition lever rotatable with respect to the support; and an extension portion coupled to the repetition lever, the extension portion being brought to slidable contact with a first guide portion, the first guide portion moving along the first surface.

A keyboard apparatus according to one embodiment of the present invention includes the support assembly; and a key configured to rotate the support of the support assembly.

DESCRIPTION OF EMBODIMENTS

Hereinafter, a keyboard apparatus including a support assembly according to one embodiment of the present invention will be described in detail with reference to the drawings. The embodiments shown below are an example of an embodiment of the present invention, and the present invention should not be interpreted as being limited to such embodiments. In the figures referenced in the present embodiment, same reference sign or similar reference sign (reference sign in which A, B, or the like is merely added after the number) may be denoted on the same portion or a portion having similar function to omit the repetitive description. Furthermore, a dimensional ratio (ratio between configurations, ratio in vertical, horizontal, and height direction, etc.) in the figure may differ from the actual ratio, or one part of the configuration may be omitted from the figure for the sake of convenience of explanation.

As the number of each component configuring the support assembly is large, the manufacturing period becomes long, and the manufacturing cost increases. Thus, it is desired to simply reduce the number of components and to simplify the structure to reduce the manufacturing cost. If the configuration of the support assembly is changed, however, the touch feeling of when operating the key greatly changes. Thus, it is difficult to reduce the manufacturing cost of the acoustic piano.

One object of the present invention is to reduce the manufacturing cost of a support assembly while suppressing the change in touch feeling of when operating the key compared to the keyboard apparatus of the acoustic piano.

First Embodiment

[Configuration of Keyboard Apparatus 1]

A keyboard apparatus 1 according to a first embodiment of the present invention is an example in which one example of a support assembly according to the present invention is applied to an electronic piano. The electronic piano has a configuration close to the support assembly of the grand piano to obtain a touch feeling close to the grand piano when operating the keys. An outline of the keyboard apparatus 1 according to the first embodiment of the present invention will be described using FIG. 1.

Figure 1:
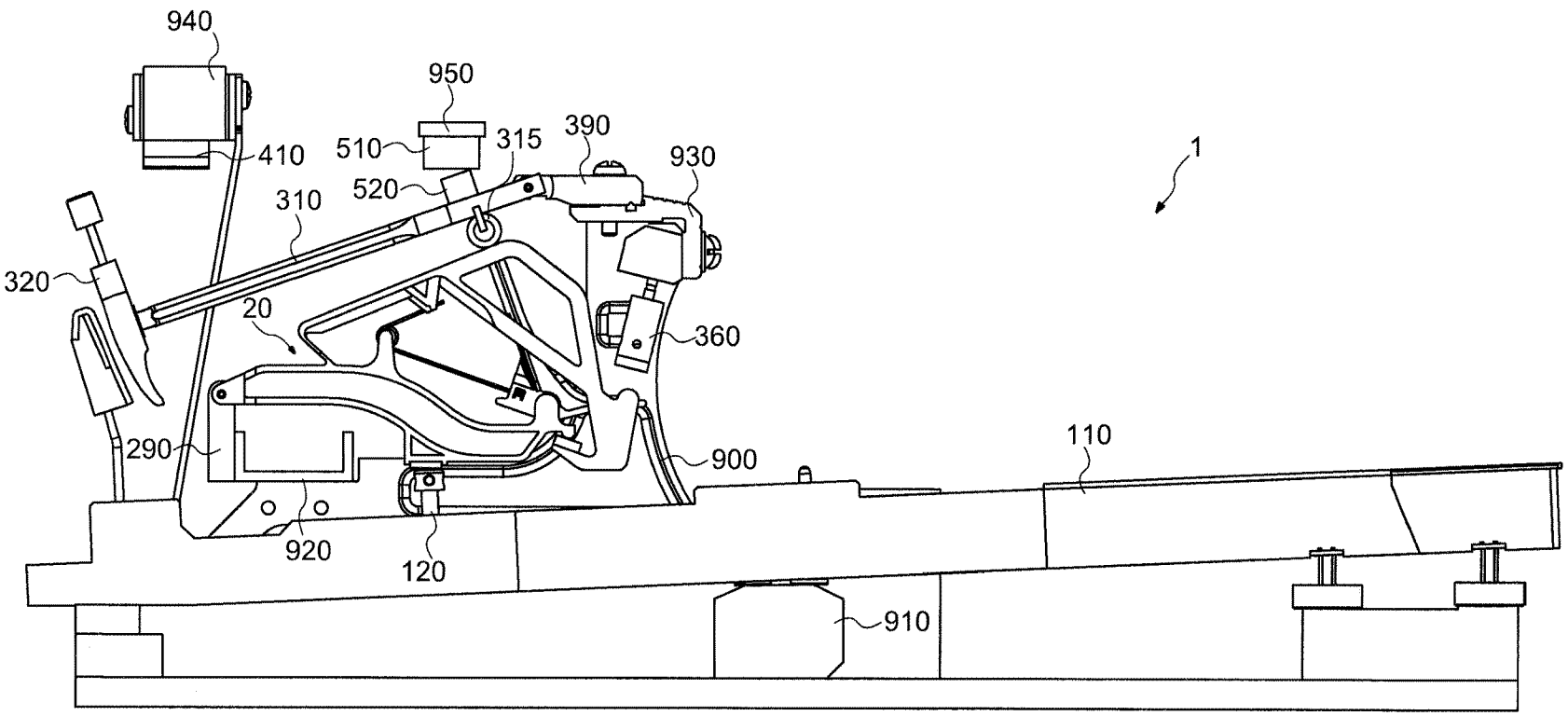
FIG. 1 is a side view showing a configuration of a keyboard apparatus according to a first embodiment of the present invention.

FIG. 1 is a side view showing a machine configuration of a keyboard apparatus according to one embodiment of the present invention. As shown in FIG. 1, the keyboard apparatus 1 according to the first embodiment of the present invention includes a plurality of keys 110 (88 keys in the example) and an action mechanism for each of the keys 110. The action mechanism includes a support assembly 20, a hammer shank 310, a hammer 320, and a hammer stopper 410. In FIG. 1, a case in which the key 110 is a white key is shown, but the key may be a black key. In the following description, terms representing direction such as "side closer to the player", "side farther away from the player", "upper side", "lower side", "laterally", and the like are defined as directions in which the keyboard apparatus is seen from the player side. For example, in the example of FIG. 1, the support assembly 20 is arranged on the side closer to the player when seen from the hammer 320, and arranged on the upper side when seen from the keys 110. The laterally corresponds to the direction in which the keys 110 are arranged.

The key 110 is rotatably supported by a balance rail 910. The key 110 is rotated within a range from a rest position to an end position shown in FIG. 1. The key 110 includes a capstan screw 120. The support assembly 20 is rotatably connected to a support flange 290, and resting on the capstan screw 120. The support flange 290 is fixed to a support rail 920. The detailed configuration of the support assembly 20 will be described later. The support flange 290 and the support rail 920 are an example of a frame to become a reference of rotating of the support assembly 20. The frame may be formed with a plurality of members such as the support flange 290 and the support rail 920, or may be formed with one member. The frame may be a rail-like member having its longitudinal direction in the direction in which the keys 110 are arranged as with the support rail 920, or may be a member independent for every key 110 as with the support flange 290.

The hammer shank 310 is rotatably connected to a shank flange 390. The hammer shank 310 includes a hammer roller 315. The hammer shank 310 is mounted on the support assembly 20 by way of the hammer roller 315. The shank flange 390 is fixed to a shank rail 930. The hammer 320 is fixed to an end of the hammer shank 310. A regulating button 360 is fixed to the shank rail 930. The hammer stopper 410 is fixed to a hammer stopper rail 940, and arranged at a position of regulating the rotating of the hammer shank 310.

A sensor 510 is a sensor for measuring a position and a moving speed (in particular, speed immediately before the hammer shank 310 impacts the hammer stopper 410) of the hammer shank 310. The sensor 510 is fixed to a sensor rail 950. In this example, the sensor 510 is a photo interrupter. An output value from the sensor 510 changes in accordance with an amount a shielding plate 520 fixed to the hammer shank 310 shields an optical axis of the photo interrupter. The position and the moving speed of the hammer shank 310 can be measured based on the output value. A sensor for measuring an operation state of the key 110 may be arranged in place of the sensor 510 or in addition to the sensor 510.

The support rail 920, the shank rail 930, the hammer stopper rail 940, and the sensor rail 950 described above are supported by a bracket 900.

[Configuration of Support Assembly 20]

Figure 2:
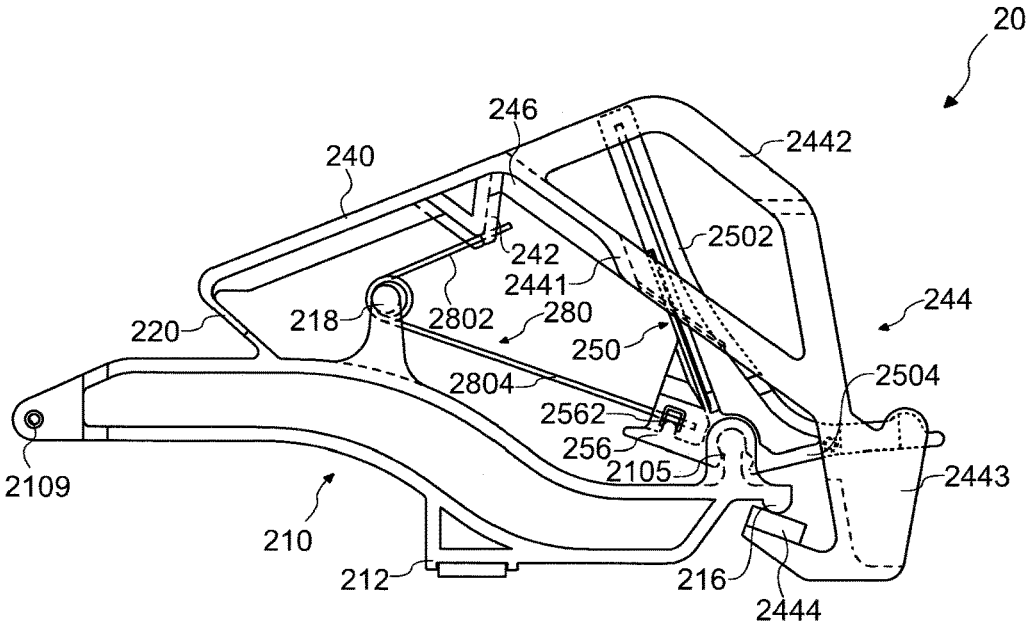
FIG. 2 is a side view showing a configuration of a support assembly according to the first embodiment of the present invention.
Figure 3A:
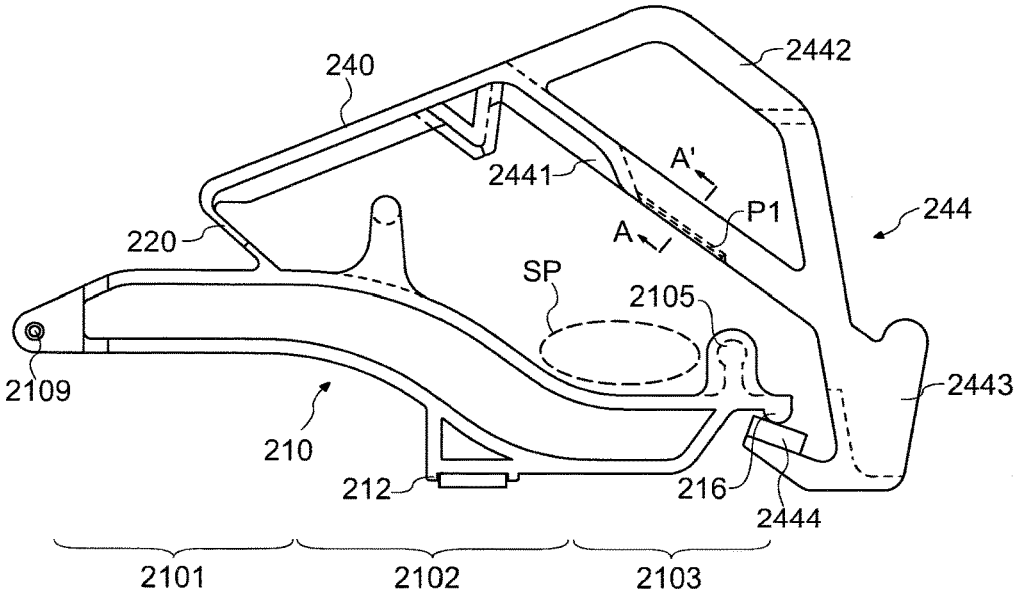
FIG. 3A is a side view showing a configuration (support) of one part in which the support assembly in the first embodiment of the present invention is disassembled.
Figure 3B:
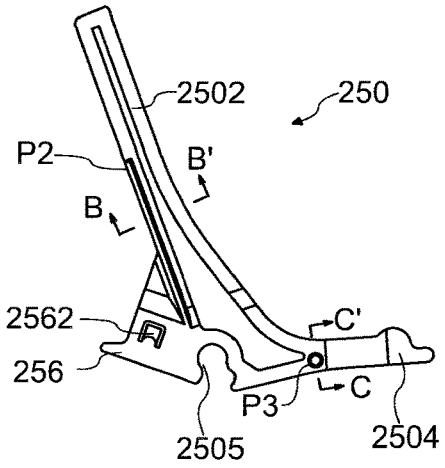
FIG. 3B is a side view showing a configuration (jack) of one part in which the support assembly in the first embodiment of the present invention is disassembled.

FIG. 2 is a side view showing a configuration of the support assembly according to the first embodiment of the present invention. FIGS. 3A and 3B are side views showing a configuration of one part in which the support assembly according to the first embodiment of the present invention is disassembled. FIG. 3A is a view in which a jack 250 and a torsion coil spring 280 are excluded from the support assembly 20 to facilitate the understanding of the features of each configuring element. FIG. 3B is a view showing only the jack 250.

The support assembly 20 includes a support 210, a repetition lever 240, the jack 250, and the torsion coil spring 280. The support 210 and the repetition lever 240 are coupled by way of a flexible portion 220. The repetition lever 240 is rotatably supported with respect to the support 210 by the flexible portion 220. The support assembly 20, other than the torsion coil spring 280 and a buffer material and the like (nonwoven fabric, elastic body, etc.) arranged at a portion of impacting another member, is a structural body made of resin manufactured by injection molding, and the like. In this example, the support 210 and the repetition lever 240 are integrally formed. Furthermore, the support 210 and the repetition lever 240 may be formed as individual components, and then adhered or joined together.

The support 210 has a through hole 2109 formed on one end side, and a jack support portion 2105 formed on the other end side. The support 210 includes a support heel 212 that projects out toward a lower side and a spring supporting portion 218 that projects out toward an upper side between the through hole 2109 and the jack support portion 2105. A shaft supported by the support flange 290 is passed through the through hole 2109. The support 210 is thereby rotatably arranged with respect to the support flange 290 and the support rail 920. The support heel 212 makes contact with the capstan screw 120, described above, at a lower surface thereof. The spring supporting portion 218 supports the torsion coil spring 280. The jack support portion 2105 rotatably supports the jack 250.

A space SP is formed on the jack support portion 2105 side of the support heel 212 at between the through hole 2109 and the jack support portion 2105. For the sake of convenience of explanation, the support 210 is sectionalized to each region of a first main body portion 2101, a bent portion 2102, and a second main body portion 2103, from the through hole 2109 side. In this case, the bent portion 2102 coupling the first main body portion 2101 and the second main body portion 2103 allows the second main body portion 2103 to be arranged on a side (lower side) closer to the key 110 than the first main body portion 2101. The jack support portion 2105 is projected out toward the upper side from the second main body portion 2103. According to such sectionalization, the space SP corresponds to a region sandwiched by the bent portion 2102 and the jack support portion 2105 at the upper side of the second main body portion 2103. A stopper 216 is coupled to an end of the support 210 (end on the second main body portion 2103 side).

A spring contact portion 242 and an extension portion 244 are coupled to the repetition lever 240. The spring contact portion 242 and the extension portion 244 are extended toward the support 210 side from the repetition lever 240. The spring contact portion 242 makes contact with a first arm 2802 of the torsion coil spring 280. The repetition lever 240 and the extension portion 244 include two plate-like members that sandwich from the side of both side surfaces of the jack 250. In this example, the extension portion 244 and the jack 250 are brought into slidable contact at least in one part of the space sandwiched by the two plate-like members.

Figure 3C:
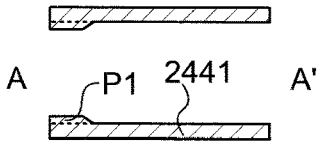
FIG. 3C is an end view taken along A-A' in FIG. 3A.

The extension portion 244 includes an inner portion 2441, an outer portion 2442, a coupling portion 2443, and a stopper contact portion 2444. The inner portion 2441 is coupled to the repetition lever 240 at the side farther away from the player (flexible portion 220 side) than a large jack 2502. A rib 246 is provided at a portion where the inner portion 2441 and the repetition lever 240 are coupled. The inner portion 2441 is intersected while sandwiching the large jack 2502, and is extended to the side closer to the player (side opposite to the flexible portion 220) than the large jack 2502. That is, it can also be said that the extension portion 244 intersects with the jack 250. The inner portion 2441 includes a linear protrusion P1 that projects out toward the large jack 2502 side at a portion of sandwiching the large jack 2502 (see FIG. 3C: end view taken along A-A').

The outer side prat 2442 is coupled to the repetition lever 240 at the side closer to the player (side opposite to the flexible portion 220) than the jack 250 (large jack 2502). The inner portion 2441 and the outer portion 2442 are coupled at the coupling portion 2443. The coupling portion 2443 sandwiches a small jack 2504. The stopper contact portion 2444 is coupled to the coupling portion 2443, and makes contact with the stopper 216 from the lower side of the stopper 216. The stopper 216 thus regulates the rotating range of the repetition lever 240 in a direction (upper side) in which the repetition lever 240 and the support 210 spread. In other words, the extension portion 244 is connected to the repetition lever 240 from the rotation center of the repetition lever 240 to the jack 250 side, and makes contact with the stopper 216 from the lower side of the stopper 216. The stopper 216 is connected to the support 210 on the lower side of the rotation center of the jack 250.

The jack 250 includes the large jack 2502, the small jack 2504, and a projecting portion 256. The jack 250 is arranged so as to be rotatable with respect to the support 210. At between the large jack 2502 and the small jack 2504, a support connecting portion 2505 to be rotatably supported by the jack support portion 2105 is formed. The support connecting portion 2505 has a shape that surrounds one part of the jack support portion 2105, and regulates the rotating range of the jack 250. Furthermore, the jack 250 can be fitted from the upper side of the jack support portion 2105 due to the shape of the support connecting portion 2505 and the elastic deformation of the material thereof. The projecting portion 256 projects out towards the side opposite the small jack 2504 from the large jack 2502, and rotates with the jack 250. The projecting portion 256 includes a spring contact portion 2562 on the side surface. The spring contact portion 2562 makes contact with a second arm 2804 of the torsion coil spring 280.

Figure 3D:
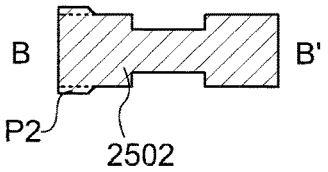
FIG. 3D is an end view taken along B-B' in FIG. 3B.
Figure 3E:
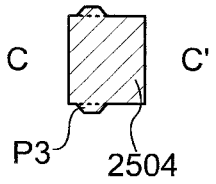
FIG. 3E is an end view taken along C-C' in FIG. 3B.
Figure 3F:
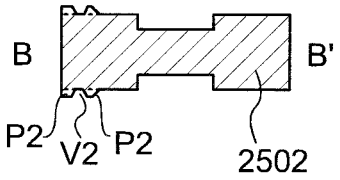
FIG. 3F is another example of an end view taken along B-B' in FIG. 3B.
Figure 3G:
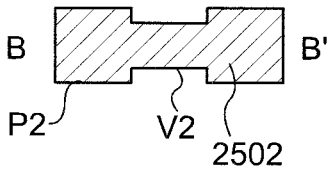
FIG. 3G is another example of an end view taken along B-B' in FIG. 3B.

The large jack 2502 includes a linear protrusion P2 that projects out from both side surfaces (see FIG. 3D: end view taken along B-B'). The protrusion P2 is brought into slidable contact with the protrusion P1 of the inner portion 2441 described above. The small jack 2504 includes a circular protrusion P3 that projects out from both side surfaces (see FIG. 3E: end view taken along line C-C'). The protrusion P3 is brought into slidable contact with the inner surface of the coupling portion 2443 described above. Thus, as the jack 250 and the extension portion 244 are brought into slidable contact through the protrusions P1, P2, P3, the contacting area can be reduced. As shown in FIG. 3F, a grease reservoir may be formed by forming a groove portion V2 with a plurality of protrusions P2. Furthermore, as shown in FIG. 3G, the protrusion P2 or the groove portion V2 may be provided in the side surface of the large jack 2502.

The torsion coil spring 280 has the first arm 2802 making contact with the spring contact portion 242 and the second arm 2804 making contact with the spring contact portion 2562 with the spring supporting portion 218 as the supporting point. The first arm 2802 functions as an elastic body that applies a rotating force on the repetition lever 240 through the spring contact portion 242 so as to move the player side of the repetition lever 240 toward the upper side (direction of moving away from the support 210). The second arm 2804 functions as an elastic body that applies a rotating force on the jack 250 through the spring contact portion 2562 so that the projecting portion 256 moves toward the lower side (direction of moving closer to the support 210). The above is the description on the configuration of the support assembly 20.

[Operation of Support Assembly 20]

Next, the operation of the support assembly 20 when the key 110 is depressed from a rest position (FIG. 1) to an end position will be described.

Figure 4:
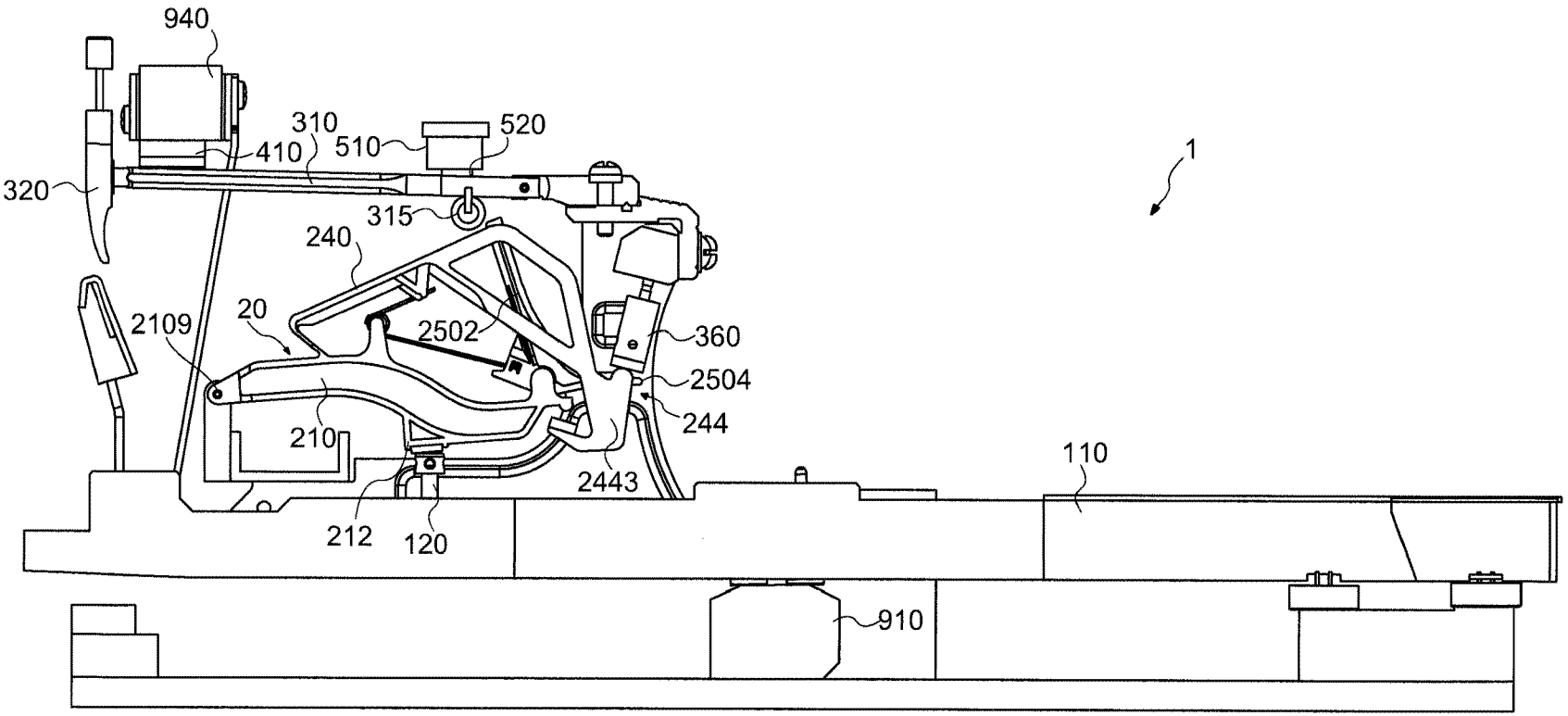
FIG. 4 is a side view describing an operation of the support assembly in the first embodiment of the present invention.

FIG. 4 is a side view describing the operation of the support assembly in the first embodiment of the present invention. When the key 110 is depressed to the end position, the capstan screw 120 presses up the support heel 212, and rotates the support 210 with an axis of the through hole 2109 as the rotation center. When the support 210 is rotated and moved to the upper side, the large jack 2502 presses up the hammer roller 315, so that the hammer shank 310 impacts the hammer stopper 410. In a conventional grand piano, this impact corresponds to string hitting by the hammer.

Immediately before this impact, the movement toward the upper side of the small jack 2504 is regulated by a regulating button 360, and the support 210 (jack support portion 2105) is further risen. Thus, the large jack 2502 is rotated so as to detach from the hammer roller 315. In this case, the movement toward the upper side of the coupling portion 2443 is also regulated by the regulating button 360. In this example, the regulating button 360 also has a function of a repetition regulating screw in the action mechanism of the conventional grand piano.

Thus, the repetition lever 240 is rotated so as to move closer to the support 210 while the movement toward the upper side is regulated. With such operation, the double escapement mechanism is realized. FIG. 4 is a view showing such state. When the key 110 is returned to the rest position, the hammer roller 315 is supported by the repetition lever 240, and the large jack 2502 is returned to the lower side of the hammer roller 315.

Thus, the double escapement is realized in a more facilitated configuration compared to the support assembly used in the general grand piano, whereby the manufacturing cost can be reduced while suppressing the influence on the touch feeling.

As the jack 250 and the extension portion 244 are brought into slidable contact, the jack 250 also functions as a guide portion of the repetition lever 240 coupled to the extension portion 244. Thus, even if yawing (side shift) and rolling (twist) of the repetition lever 240 tend to easily occur due to the connection of the repetition lever 240 to the flexible portion 220, the occurrence of such phenomenon can be suppressed. In other words, the rotating of the repetition lever 240 along a surface in which the jack 250 is rotated can be easily realized.

As the jack 250 is rotated with respect to the support 210, the repetition lever 240 can be indirectly rotated along the surface in which the support 210 is rotated. Thus, a member (jack 250 in this example) that functions as the guide portion merely needs to be a member that moves along the surface in which the support 210 is rotated. In this case, the configuration for guiding the jack 250 may be arranged in the support 210 so that the jack 250 is rotated along the surface in which the support 210 is rotated. Accordingly, the accuracy of rotating the repetition lever 240 along the surface in which the support 210 is rotated through the jack 250 can be further enhanced.

[Sound Generating Mechanism of Keyboard Apparatus 1]

The keyboard apparatus 1 is an application example to the electronic piano as described above. The operation of the key 110 is measured with the sensor 510, and a sound corresponding to the measurement result is output.

Figure 5:
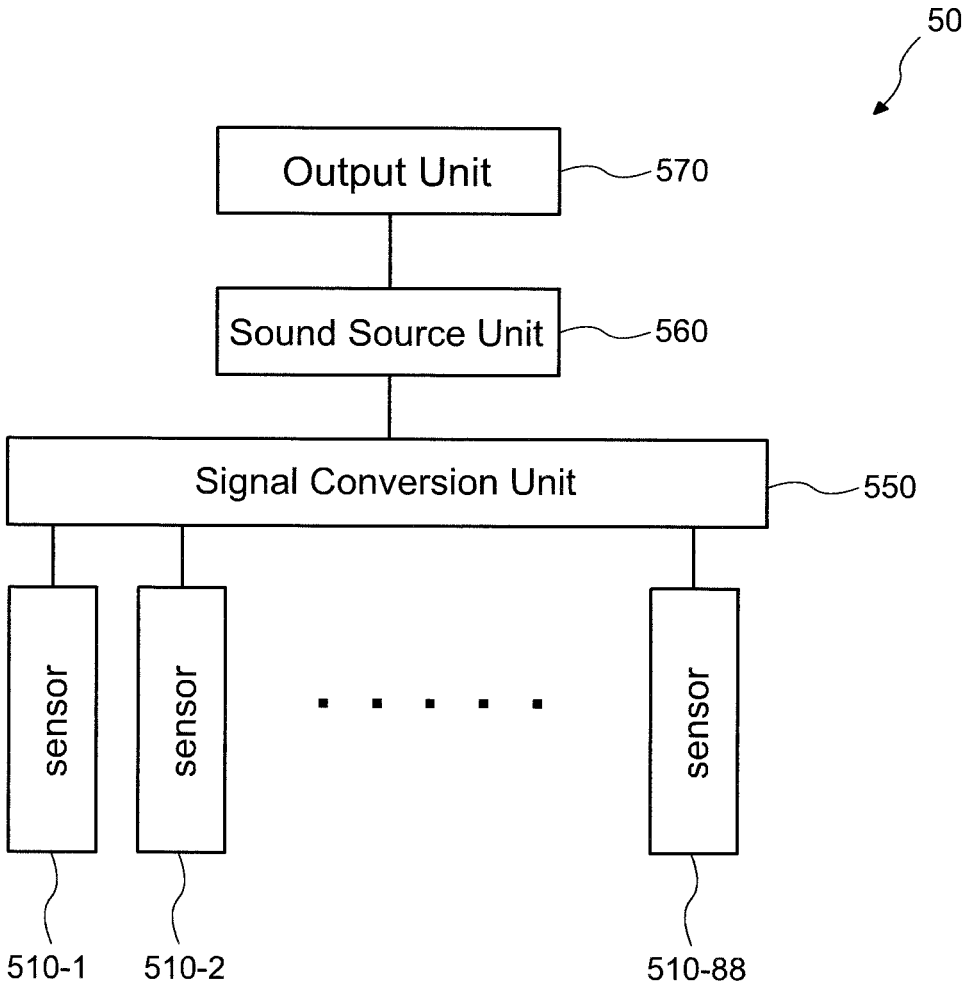
FIG. 5 is a block diagram showing a configuration of a sound generating mechanism of the keyboard apparatus in the first embodiment of the present invention.

FIG. 5 is a block diagram showing a configuration of a sound generating mechanism of the keyboard apparatus in the first embodiment of the present invention. A sound generating mechanism 50 of the keyboard apparatus 1 includes the sensor 510 (sensors 510-1, 510-2, . . . , 510-88 corresponding to 88 keys 110), a signal conversion unit 550, a sound source unit 560, and an output unit 570. The signal conversion unit 550 acquires an electric signal output from the sensor 510, generates an operation signal corresponding to the operation state in each key 110 and outputs the operation signal. In this example, the operation signal is a signal of MIDI format. Thus, the signal conversion unit 550 outputs a note ON in correspondence with a timing the hammer shank 310 impacts the hammer stopper 410 by the key depression operation. In this case, a key number indicating which one of the 88 keys 110 is operated and a velocity corresponding to the speed immediately before the impact are also output in correspondence with the note ON. On the other hand, when the key release operation is carried out, the signal conversion unit 550 outputs the key number and the note OFF in correspondence to each other in correspondence with a timing the vibration of the string is stopped by a damper in the case of the grand piano. The signal conversion unit 550 may be input with a signal corresponding to other operations of a pedal, and the like, and reflected on the operation signal. The sound source unit 560 generates a sound signal based on the operation signal output from the signal conversion unit 550. The output unit 570 is a speaker or a terminal that outputs the sound signal generated by the sound source unit 560.

According to one embodiment of the present invention, the manufacturing cost of the support assembly can be reduced while suppressing the change in touch feeling of when operating the key compared to the keyboard apparatus of the acoustic piano.

Second Embodiment

In the first embodiment described above, the extension portion 244 includes the inner portion 2441 and the outer portion 2442, and is coupled with the repetition lever 240 at two areas. In the second embodiment, an example in which the repetition lever and the extension portion are coupled at one area will be described.

Figure 6:
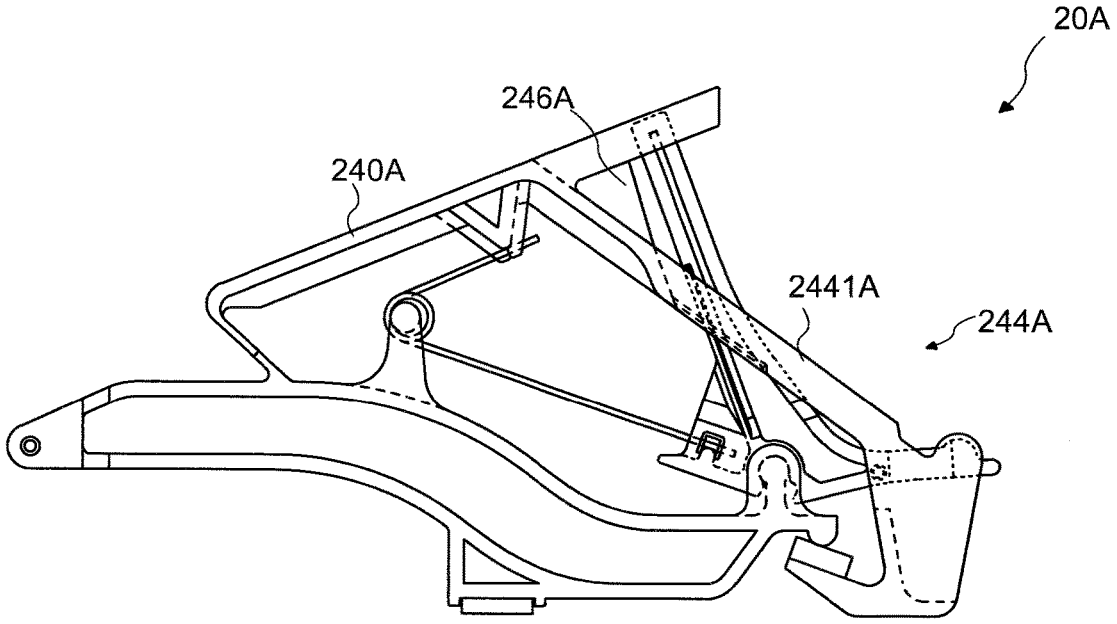
FIG. 6 is a side view showing a configuration of a support assembly according to a second embodiment of the present invention.

FIG. 6 is a side view showing a configuration of a support assembly according to a second embodiment of the present invention. A support assembly 20A has a repetition lever 240A and an extension portion 244A coupled at one area. In this example, the extension portion 244A includes an inner portion 2441A, and does not have a configuration corresponding to the outer portion 2442 in the first embodiment. In this example, a rib 246A is formed on the side closer to the player (side opposite the flexible portion 220) of a portion where the repetition lever 240A and the inner portion 2441A are coupled.

Third Embodiment

In a third embodiment, an example of a support assembly in which the repetition lever and the extension portion are coupled at one area, the repetition lever and the extension portion being coupled at a position different from the second embodiment, will be described.

Figure 7:
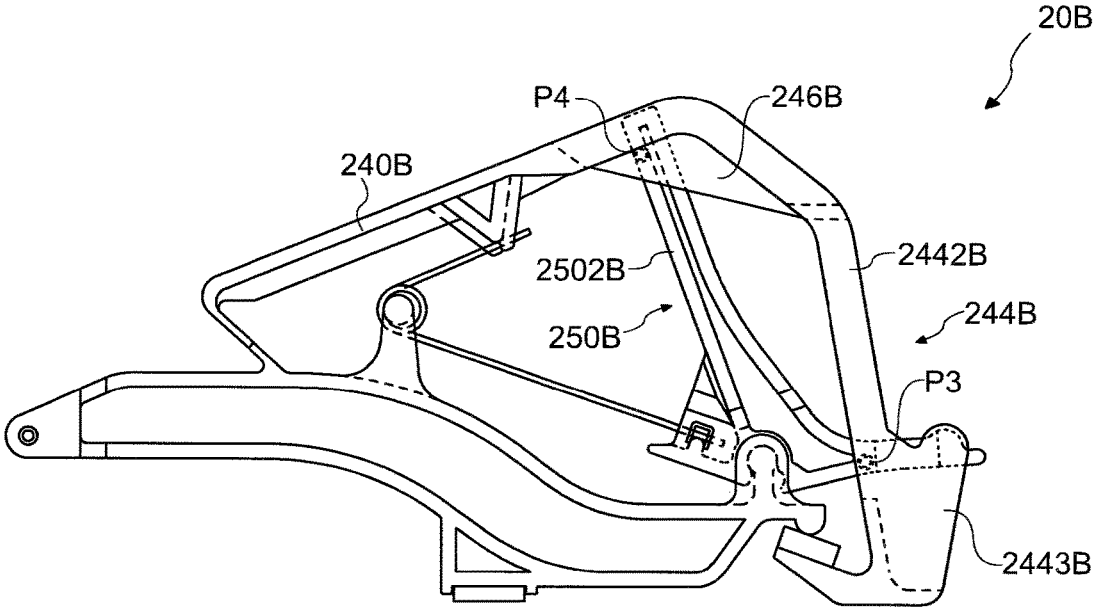
FIG. 7 is a side view showing a configuration of the support assembly according to a third embodiment of the present invention.

FIG. 7 is a side view showing a configuration of the support assembly according to a third embodiment of the present invention. A support assembly 20B has the repetition lever 240B and an extension portion 244B coupled at one area. In this example, the extension portion 244B includes an outer portion 2442B, and does not have a configuration corresponding to the inner portion 2441 in the first embodiment. In this example, as shown in FIG. 7, a rib 246B is formed at a portion where the repetition lever 240B and the outer portion 2442B are coupled. The rib 246B is formed with two plate-like members so as to sandwich a large jack 2502B of the jack 250B. In this example, a protrusion P4 that makes a slidable contact with the rib 246B is arranged on the large jack 2502B. The protrusion P4 has a shape similar to the protrusion P3.

Fourth Embodiment

In the first embodiment, the jack 250 realized the function of the guide portion that guides the rotating direction of the repetition lever 240 by making a slidable contact with the extension portion 244. In the fourth embodiment, an example in which a member coupled to the support realizes the function of the guide portion will be described.

Figure 8A:
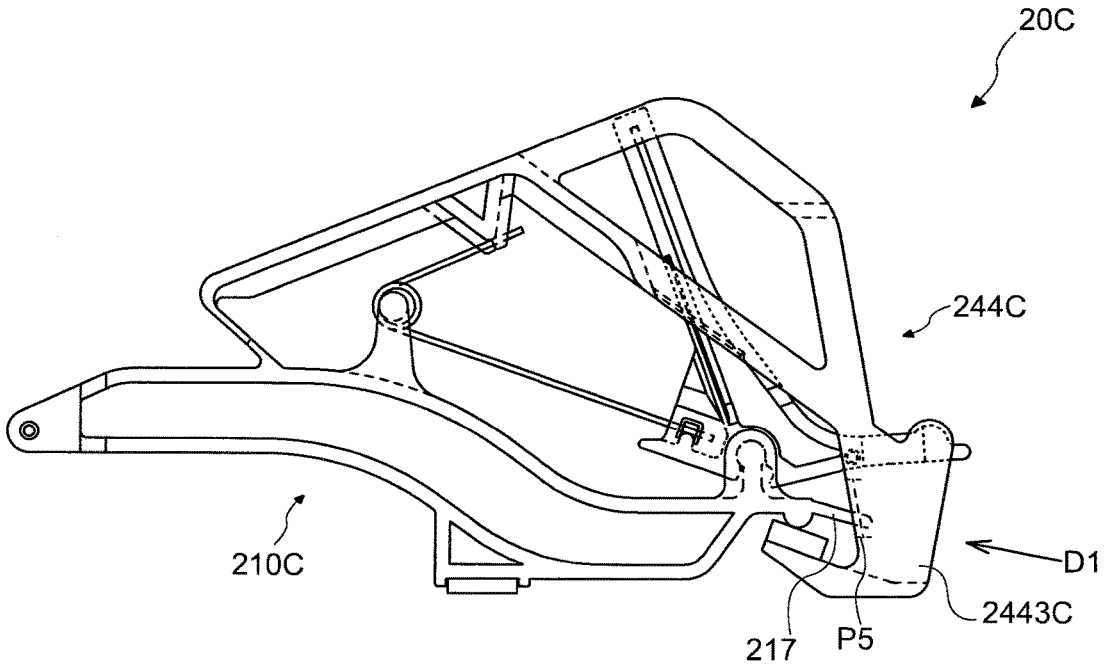
FIG. 8A is a side view showing a configuration of a support assembly according to a fourth embodiment of the present invention.
Figure 8B:
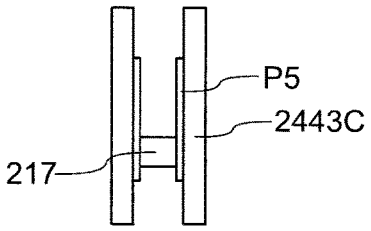
FIG. 8B is a view when a portion where a coupling portion and a projecting portion are brought into slidable contact is seen in a direction of an arrow D1.

FIG. 8A is a side view showing a configuration of a support assembly according to a fourth embodiment of the present invention. As shown in FIG. 8A, a support assembly 20C includes a projecting portion 217 connected to an end of the support 210C. A coupling portion 2443C of the extension portion 244C is arranged to sandwich the projecting portion 217. A protrusion P5 that makes a slidable contact with the projecting portion 217 is arranged on the coupling portion 2443C. FIG. 8B is a view when a portion where the coupling portion 2443C and the projecting portion 217 are brought into slidable contact is seen in a direction of an arrow D1.

Fifth Embodiment

In the first embodiment, the jack 250 realized the function of the guide portion by making a slidable contact with the extension portion 244. In the fifth embodiment, an example in which a member coupled to the jack realizes the function of the guide portion will be described.

Figure 9A:
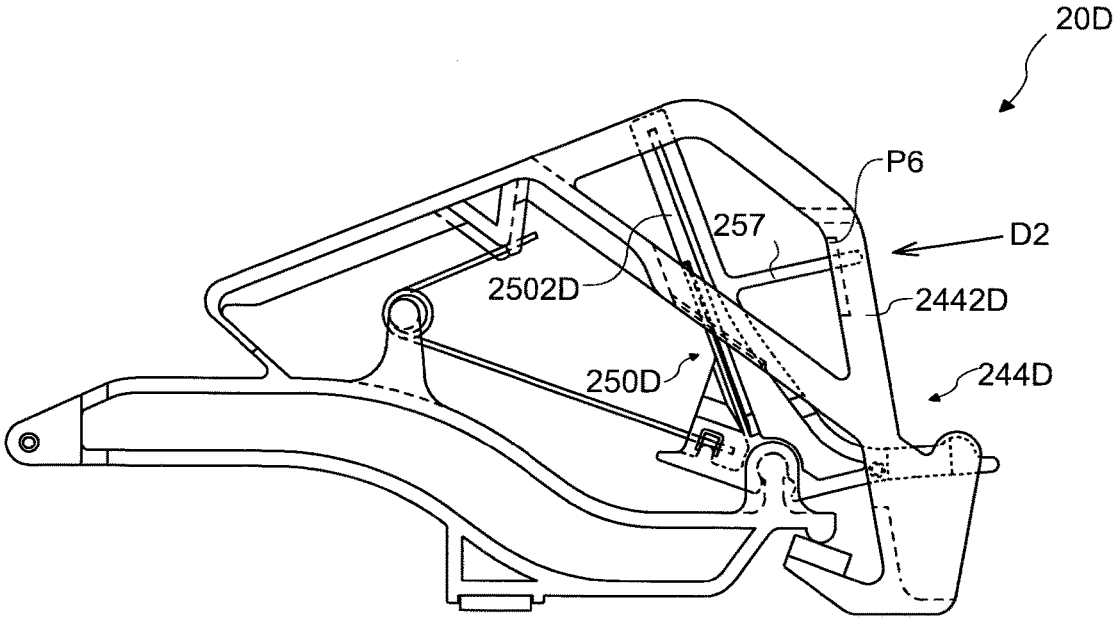
FIG. 9A is a side view showing a configuration of a support assembly according to a fifth embodiment of the present invention.
Figure 9B:
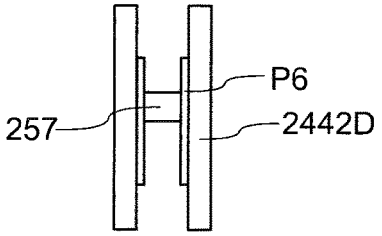
FIG. 9B is a view when a portion where an outer portion and a projecting portion are brought into slidable contact is seen in a direction of an arrow D2.

FIG. 9A is a side view showing a configuration of a support assembly according to a fifth embodiment of the present invention. A support assembly 20D includes a jack 250D and an extension portion 244D. The jack 250D includes a projecting portion 257 connected to a large jack 2502D. The extension portion 244D includes an outer portion 2442D including a protrusion P6. The outer portion 2442D of the extension portion 244D is arranged so as to sandwich the projecting portion 257. The protrusion P6 that makes a slidable contact with the projecting portion 257 is arranged on the outer portion 2442D. FIG. 9B is a view when a portion where the outer portion 2442D and the projecting portion 257 are brought into slidable contact is seen in a direction of an arrow D2.

Sixth Embodiment

[Configuration of Keyboard Apparatus 1E]

A keyboard apparatus 1E according to a sixth embodiment of the present invention is an example in which one example of the support assembly according to the present invention is applied to the electronic piano, similar to the keyboard apparatus 1 of the first embodiment. The keyboard apparatus 1E is similar to the keyboard apparatus 1, but differs in the support assembly and a supporting structure of the support assembly. Furthermore, the keyboard apparatus 1E differs from the keyboard apparatus 1 in the method of regulating the rotating toward the upper side of the repetition lever arranged in the support assembly. In the following description, the difference mentioned above will be centrally described, and the description on the common part will be omitted.

Figure 10:
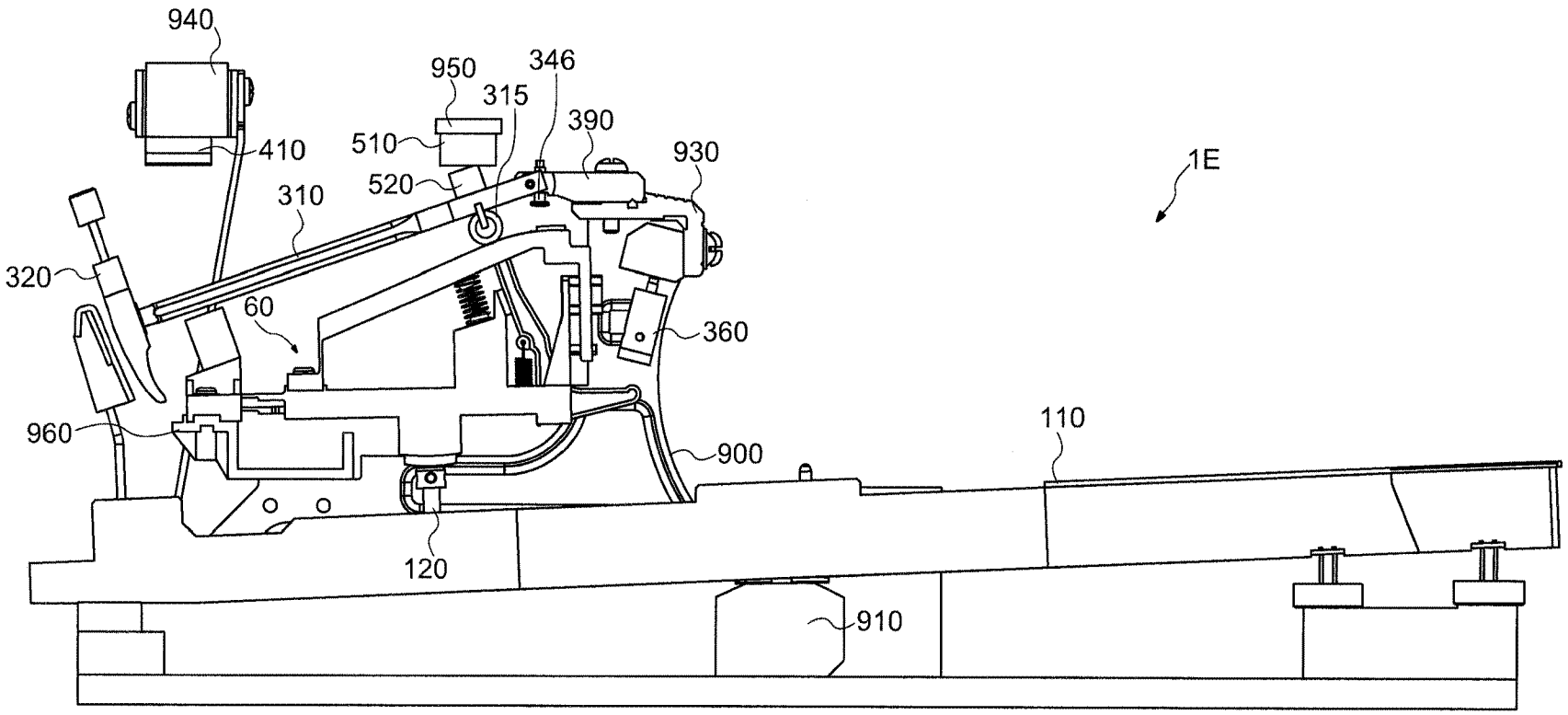
FIG. 10 is a side view showing a configuration of a keyboard apparatus according to a sixth embodiment of the present invention.

FIG. 10 is a side view showing a configuration of the keyboard apparatus according to the sixth embodiment of the present invention. A support assembly 60 is fixed to a support rail 960. The support rail 960 is supported by the bracket 900. The support assembly 20 in the first embodiment is rotatably supported as the shaft supported by the support flange 290 is passed through the through hole 2109. The support assembly 60, on the other hand, is similar in that the support 610 is rotatably supported by the support rail 960, but the supporting method thereof is different, as will be described later. A repetition regulating screw 346 regulates the rotating toward the upper side (toward the hammer shank 310 side) of the support assembly 60. The support rail 960 is an example of a frame to become a reference of rotating of the support assembly 60. The frame may be formed with one member as with the support rail 960, or may be formed with a plurality of members. The frame may be a rail-like member having its longitudinal direction in the direction in which the keys 110 are arranged as with the support rail 960, or may be a member independent for every key 110.

[Configuration of Support Assembly 60]

Figure 11:
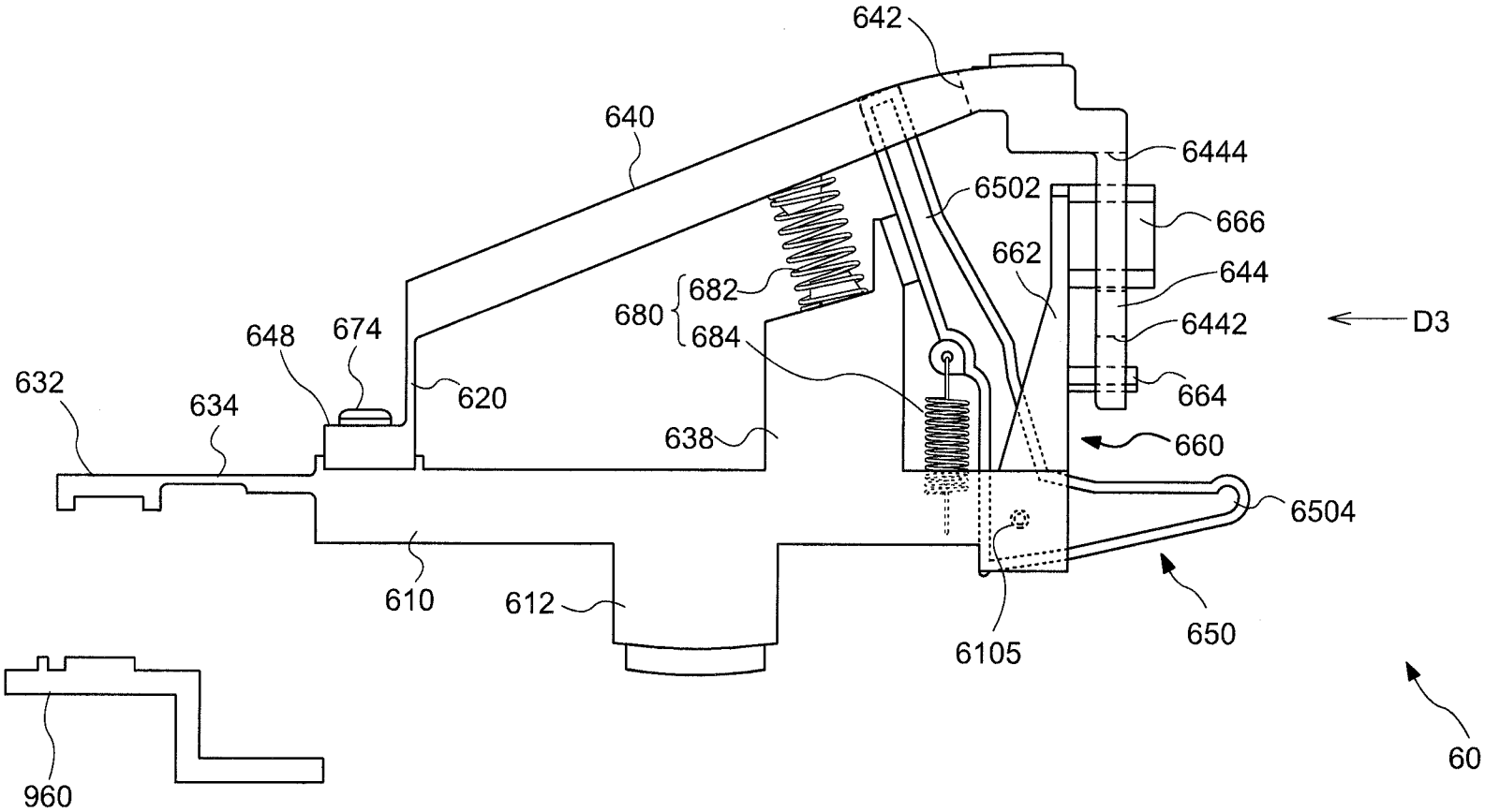
FIG. 11 is a side view showing a configuration of a support assembly according to the sixth embodiment of the present invention.

FIG. 11 is a side view showing a configuration of a support assembly according to the sixth embodiment of the present invention. The support assembly 60 of the keyboard apparatus 1E includes a support 610, a repetition lever 640, a jack 650, a movement regulating portion 660, and a coil spring 680. The support assembly 60, other than the coil spring 680 and a buffer material and the like (nonwoven fabric, elastic body, etc.) arranged at a portion of impacting another member, is a structural body made of resin manufactured by injection molding and the like.

The support 610 is rotatably supported with respect to the support rail 960. The repetition lever 640 is rotatably supported by the support 610. The jack 650 is rotatably arranged on the support 610. The jack 650 includes a large jack 6502 and a small jack 6504. The large jack 6502 is arranged to pass through a slit 642 formed in the repetition lever 640. The small jack 6504 is extended from the support 610 toward the side closer to the player. The movement regulating portion 660 is arranged on the repetition lever 640 side of the support 610.

The support 610 includes a support heel 612, a frame fixing portion 632, a flexible portion 634, and a base 638. The frame fixing portion 632 fixes the support 610 to the support rail 960. The flexible portion 634 is arranged between the support 610 and the frame fixing portion 632 of the respective support assembly 60, and has flexibility (elasticity). Furthermore, the flexible portion 634 is integrally formed with the support 610 and the frame fixing portion 632, and has a thinner plate thickness than at least the support 610 in the rotating direction of the support assembly 60 or the plate thickness direction of the flexible portion 634. In FIG. 11, a structure in which the support 610, the frame fixing portion 632, and the flexible portion 634 are integrally formed is illustrated, but such structure is not the only case. For example, the flexible portion 634 may be fixed to both or one of the support 610 and the frame fixing portion 632 with a fixing piece, an adhesive, welding, or the like. The flexible portion 634 is the rotation center of the support assembly 60.

The base 638 is connected to the repetition lever 640 side of the support 610, and a coil spring 682 that acts on the base 638 and the repetition lever 640 is arranged on an upper surface (repetition lever 640 side) of the base 638. The coil spring 682 is a compression spring that acts on the base 638 and the repetition lever 640 in the direction in which the base 638 and the repetition lever 640 move away from each other, and that functions as an elastic body that applies a rotating force on the repetition lever 640.

The repetition lever 640 includes the flexible portion 620, the slit 642, an extension portion 644, and a support fixing portion 648.

The flexible portion 620 is extended toward the support 610 side of the repetition lever 640, and is coupled to the support fixing portion 648. That is, the flexible portion 620 is arranged between the repetition lever 640 and the support fixing portion 648. The flexible portion 620 is integrally formed with the support fixing portion 648 and the repetition lever 640, but the flexible portion 620 has flexibility (elasticity) as the plate thickness of the flexible portion 620 is thinner than the plate thickness of the repetition lever 640. Therefore, the repetition lever 640 is rotated with the flexible portion 620 as the center.

The slit 642 is provided at a position the large jack 6502 can pass through at one part on the side closer to the player from the flexible portion 620, which is the rotation center of the repetition lever 640. The extension portion 644 is coupled to the support 610 side of the repetition lever 640 on the jack 650 side from the flexible portion 620, which is the rotation center of the repetition lever 640. Furthermore, the extension portion 644 includes slits 6442 and 6444. The support fixing portion 648 is fixed to the support 610 with a fixing piece 674.

In FIG. 11, a structure in which the repetition lever 640, the flexible portion 620, and the support fixing portion 648 are integrally formed has been illustrated, but such structure is not the only case. For example, the flexible portion 620 may be fixed to both or one of the repetition lever 640 and the support fixing portion 648 with a fixing piece, an adhesive, welding, or the like.

The jack 650 includes the large jack 6502 and the small jack 6504. The jack 650 is arranged to be rotatable with respect to the support 610 at a jack support portion 6105. The coil spring 684 that acts on the large jack 6502 and the support 610 is arranged at one part of the large jack 6502. The coil spring 684 is a tension spring that acts on the large jack 6502 and the support 610 in the direction in which the large jack 6502 moves closer to the base 638, and that functions as an elastic body that applies a rotating force with respect to the jack 650.

The movement regulating portion 660 is arranged on a side opposite to the flexible portion 634 with the flexible portion 620 as a reference. The movement regulating portion 660 includes an extension portion 662 (second extension portion), a stopper 664, and a guide 666. The extension portion 662 is arranged on the repetition lever 640 side of the support 610. The stopper 664 and the guide 666 are arranged on the extension portion 662, and respectively extended from the extension portion 662 toward the side closer to the player. In other words, the stopper 664 and the guide 666 can also be said as projections that project out from the extension portion 662 toward the side closer to the player. The stopper 664 is passed through the slit 6442 formed in the extension portion 644 (first extension portion), and the guide 666 is passed through the slit 6444 formed in the extension portion 644. The slits 6442 and 6444 merely need to have a shape that allows the stopper 664 and the guide 666 to be locked, and for example, may be a shape including a groove to which the stopper 664 and the guide 666 can be locked. The slits 6442 and 6444 may also be referred to as lock portions.

Figure 12A:
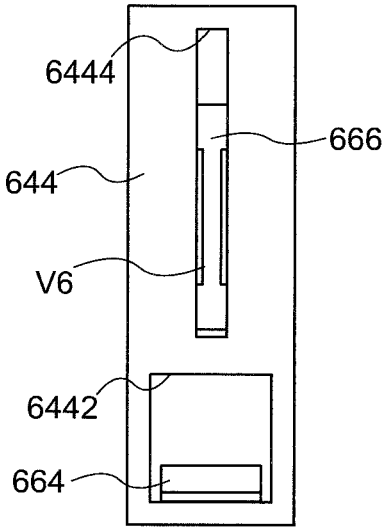
FIG. 12A is a side view showing a configuration (rest position) of a stopper and a guide of the support assembly according to the sixth embodiment of the present invention.
Figure 12B:
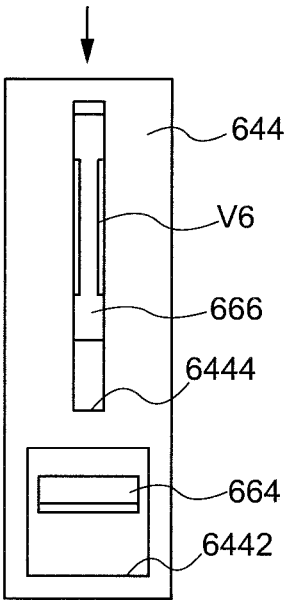
FIG. 12B is a side view showing a configuration (end position) of the stopper and the guide of the support assembly according to the sixth embodiment of the present invention.

The side views shown in FIGS. 12A and 12B are views showing only the extension portion 644, the stopper 664, and the guide 666 in the side views seen from a D3 direction in FIG. 11. FIG. 12A shows a side view of the rest position. FIG. 12B shows a side view of the end position. The stopper 664 has its longitudinal direction in the direction intersecting in the rotating direction of the repetition lever 640 and the extension portion 644. Furthermore, the guide 666 and the slit 6444 have the longitudinal direction in the rotating direction of the repetition lever 640 and the extension portion 644. The guide 666 includes a groove portion V6 with respect to an inner wall of the slit 6444, thus reducing the area in which the guide 666 and the slit 6444 make a slidable contact. Grease may be applied to the groove portion V6.

At the rest position shown in FIGS. 11 and 12A, the extension portion 644 is brought into contact with the stopper 664 from the support 610 side (lower side) of the stopper 664 in the slit 6442. In other words, the extension portion 644 is brought into contact with respect to the movement regulating portion 660 from the lower side of the movement regulating portion 660. That is, the stopper 664 or the movement regulating portion 660 regulates the rotating toward the hammer shank 310 side (upper side) of the repetition lever 640 and the extension portion 644. A buffer material, and the like (nonwoven fabric, elastic body, etc.) for reducing the noise generated when the extension portion 644 and the stopper 664 are brought into contact may be arranged between the extension portion 644 and the stopper 664.

Furthermore, the extension portion 644 is brought into contact with the guide 666 from the laterally in the slit 6444. Here, the laterally is the direction in which the support assembly 60 is adjacent, or the extended direction of the support rail 960. In other words, the extension portion 644 is brought into contact with the movement regulating portion 660 from the laterally. That is, the guide 666 or the movement regulating portion 660 suppresses the yawing and the rolling of the repetition lever 640. A grease for making the slidable movement of the extension portion 644 and the guide 666 smooth may be applied between the extension portion 644 and the guide 666.

In FIGS. 11, 12A and 12B, a configuration in which a slit is formed in the extension portion 644 connected to the repetition lever 640 and a projection is formed on the extension portion 662 connected to the support 610 has been illustrated, but such configuration is not the only case. For example, a configuration in which the slit is formed in the extension portion 662 and the projection that passes through the slit is formed on the extension portion 644 may be adopted.

Thus, according to the keyboard apparatus 1E of the second embodiment of the present invention, the number of components configuring the support assembly can be reduced while ensuring the operation of the support assembly to the same extent as the prior art. Therefore, the manufacturing cost of the support assembly can be reduced while suppressing the change in the touch feeling when operating the key.

As the guide 666 and the extension portion 644 are brought into slidable contact, the guide 666 also functions as a guide portion of the repetition lever 640 coupled to the extension portion 644. Thus, the occurrence of yawing and rolling of the repetition lever 640 can be suppressed.

[Operation of Support Assembly 60]

Now, the operation of the support assembly 60 when the key 110 is depressed from the rest position (FIG. 10) to an end position will be described.

Figure 13:
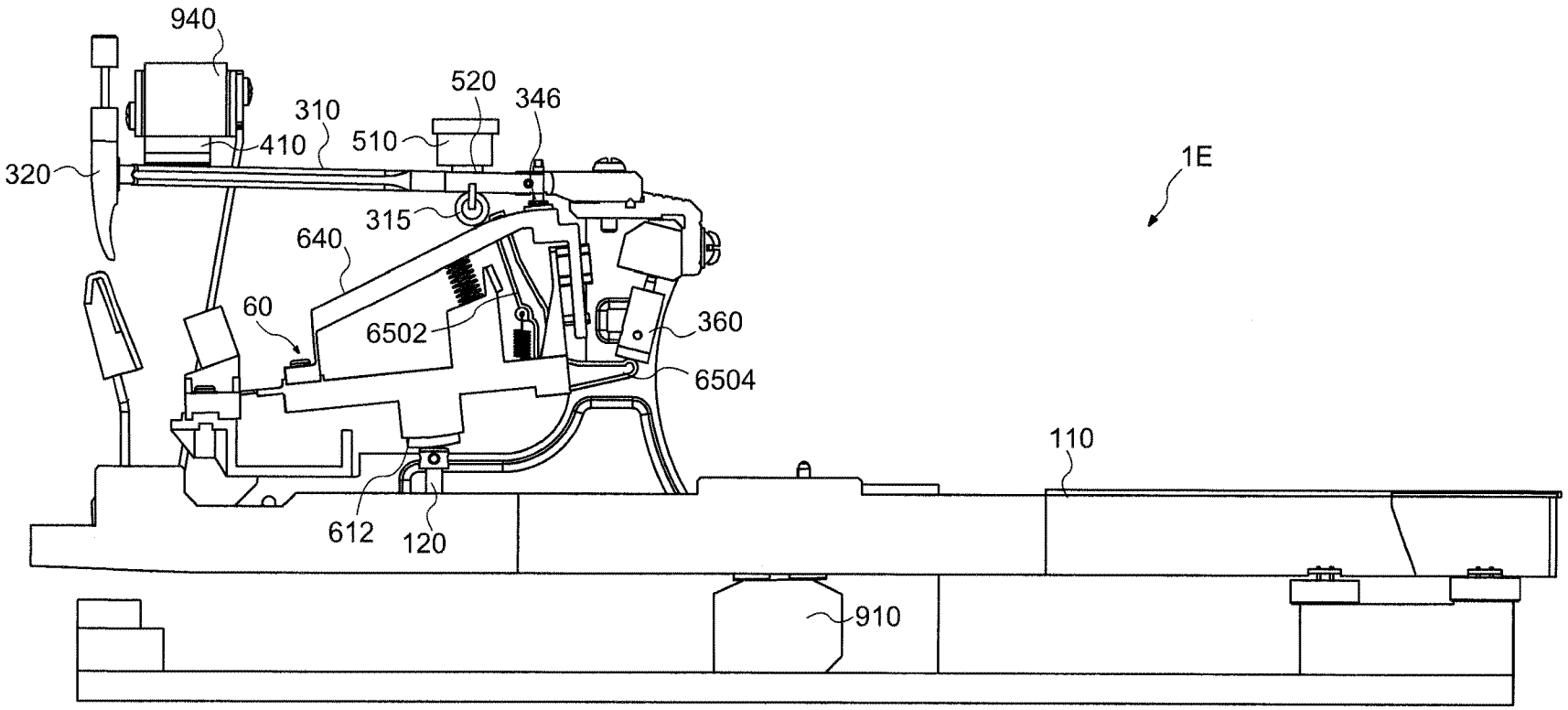
FIG. 13 is a side view for describing the operation of the support assembly according to the sixth embodiment of the present invention.

FIG. 13 is a side view describing the operation of the support assembly according to the sixth embodiment of the present invention. When the key 110 is depressed to the end position, the capstan screw 120 presses up the support heel 612, and rotates the support 610 with an axis of the flexible portion 634 as the rotation center. When the support 610 is rotated and moved to the upper side, the large jack 6502 presses up the hammer roller 315 and the hammer shank 310 impacts the hammer stopper 410.

Immediately before the impact, the movement toward the upper side of the small jack 6504 is regulated by the regulating button 360, and the support 610 (jack support portion 6105) is further raised. Thus, the large jack 6502 is rotated so as to detach from the hammer roller 315. In this case, the movement toward the upper side of the repetition lever 640 is also regulated by the repetition regulating screw 346. Thus, the repetition lever 640 is rotated so as to move closer to the support 610 with the movement toward the upper side regulated. According to such operations, the double escapement mechanism is realized. FIG. 13 is a view showing such state. When the key 110 is returned to the rest position, the hammer roller 315 is supported by the repetition lever 640, and the large jack 6502 is returned to the lower side of the hammer roller 315.

Even such support assembly 60 has effects similar to the support assembly 20. In other words, in a more facilitated configuration compared to the support assembly used in the general grand piano, the double escapement is realized, and hence the manufacturing cost can be reduced while suppressing the influence on the touch feeling.

Furthermore, as the guide 666 and the extension portion 644 are brought into slidable contact, the guide 666 also functions as a guide portion of the repetition lever 640 coupled to the extension portion 644. Thus, even if the yawing (side shift) and the rolling (twist) of the repetition lever 640 tend to easily occur from the connection of the repetition lever 640 to the flexible portion 620, the occurrence of such phenomenon can be suppressed. In other words, the rotating of the repetition lever 640 along the surface in which the support 610 is rotated can be easily realized.

<Modification Example>

In the embodiment described above, the portion that functions as the guide portion is found in two areas. For example, in the first embodiment, two areas, the portion (protrusion P2) that is brought into slidable contact with the extension portion 244 of the large jack 2502 and the portion (protrusion P3) that is brought into slidable contact with the extension portion 244 of the small jack 2504 function as the guide portion. The guide portion at such two areas exist in different directions when seen from the rotation center of the repetition lever 240. The effect of suppressing the occurrence of yawing and rolling can be enhanced if the guide portion exists in such manner. However, this does not inhibit the guide portion from being provided at one area. Furthermore, the guide portion may be provided at three or more areas. In this case, it is desirable that each guide portion exists in different directions when seen from the rotation center of the repetition lever 240, as described above.

In the embodiment described above, the extension portion sandwiches the guide portion. For example, in the first embodiment, the extension portion 244 is formed with two plate-like members so as to sandwich the jack 250. On the contrary, a configuration in which the extension portion 244 is sandwiched by the jack 250 may be adopted, that is, at least one part of the jack 250 may be formed with two plate-like members that sandwich the extension portion 244.

In the embodiment described above, at least one of the guide portions exists on the side closer to the player than the rotating shaft of the jack (e.g., side opposite to the flexible portion 220 with respect to the rotating shaft of the jack 250 in the first embodiment). The guide portion may be located on the side farther away from the player than the large jack (flexible portion 220 side with respect to the rotating shaft of the jack 250). For example, in the first embodiment, the projection that projects out toward the upper side from the support 210 may be provided, and the extension portion coupled to the repetition lever 240 may be brought into slidable contact with the relevant projection.

In the embodiment described above, the repetition lever is coupled with respect to the support by way of the flexible portion. The extension portion can be coupled with respect to the repetition lever of the support assembly used in the conventional grand piano. The member coupled to the support or the jack may be brought into slidable contact with the extension portion as the guide portion.

In the embodiments described above, the electronic piano has been described as an example of the keyboard apparatus to which the support assembly is applied. The support assembly of the embodiments described above can also be applied to the grand piano (acoustic piano). In this case, the sound generating mechanism corresponds to the hammer and the string. The string generates a sound when hit by the hammer in response to the depression of the key.

REFERENCE SIGNS LIST

1 . . . keyboard apparatus
110 . . . key
20 . . . support assembly
210 . . . support
2101 . . . first main body portion
2102 . . . bent portion
2103 . . . second main body portion
2105 . . . jack support portion
2109 . . . through hole
212 . . . support heel
216 . . . stopper
218 . . . spring supporting portion
220 . . . flexible portion
240 . . . repetition lever
242 . . . spring contact portion
244 . . . extension portion
2441 . . . inner portion
2442 . . . outer portion
2443 . . . coupling portion
2444 . . . stopper contact portion
250 . . . jack
2502 . . . large jack
2504 . . . small jack
2505 . . . support connecting portion
256 . . . projecting portion
2562 . . . spring contact portion
280 . . . torsion coil spring
2802 . . . first arm
2804 . . . second arm
290 . . . support flange
310 . . . hammer shank
315 . . . hammer roller
320 . . . hammer
346 . . . repetition regulating screw
360 . . . regulating button
390 . . . shank flange
410 . . . hammer stopper
50 . . . sound generating mechanism
510 . . . sensor
520 . . . shielding plate
550 . . . signal conversion unit
560 . . . sound source unit
570 . . . output unit
60 . . . support assembly
610 . . . support
6105 . . . jack support portion
612 . . . support heel
620 . . . flexible portion
632 . . . frame fixing portion
634 . . . flexible portion
638 . . . base
640 . . . repetition lever
644, 646 . . . extension portion
642, 6442, 6444 . . . slit
648 . . . support fixing portion
650 . . . jack

6502 . . . large jack
6504 . . . small jack
660 . . . movement regulating portion
662 . . . extension portion
664 . . . stopper
666 . . . guide
674 . . . fixing piece
680, 682, 684 . . . coil spring
900 . . . bracket
910 . . . balance rail
920 . . . support rail
930 . . . shank rail
940 . . . hammer stopper rail
950 . . . sensor rail
960 . . . support rail

What is claimed is:

1. A support assembly comprising:

a support rotatable along a first surface with respect to a frame;

a repetition lever rotatable with respect to the support; and an extension portion coupled to the repetition lever, the extension portion being in slidable contact with a first guide portion, the first guide portion moving along the first surface.

2. The support assembly according to claim 1, further comprising a flexible portion rotatably supporting the repetition lever with respect to the support.

3. The support assembly according to claim 2, wherein the first guide portion is arranged on a side opposite the flexible portion with respect to a large jack connected to the support.

4. The support assembly according to claim 1, wherein the first guide portion is a jack connected to the support.

5. The support assembly according to claim 4, wherein the jack includes a large jack and a small jack, and the large jack and the small jack are slidable contact with the extension portion.

6. The support assembly according to claim 5, wherein the extension portion is coupled to the repetition lever at a position closer to a rotation center of the repetition lever than the large jack.

7. The support assembly according to claim 1, wherein the first guide portion is a member coupled to a jack, and the jack connected to the support.

8. The support assembly according to claim 7, wherein the jack includes a large jack and a small jack, and the member is a projecting portion connected to the large jack.

9. The support assembly according to claim 1, wherein the first guide portion is coupled with respect to the support.

10. The support assembly according to claim 1, wherein at least one of the extension portion and the guide portion includes a protrusion on a slidably moving surface side of the extension portion and the first guide portion.

11. The support assembly according to claim 10, wherein the protrusion includes a linear protrusion.

12. The support assembly according to claim 1, wherein at least one of the extension portion and the guide portion includes a groove portion on a slidably moving surface side of the extension portion and the first guide portion.

13. The support assembly according to claim 1, further comprising a second guide portion moving along the first surface, wherein the extension portion is slidable contact with the second guide portion, and the first guide portion and the second guide portion are arranged in a different direction when seen from a rotation center of the repetition lever.

14. The support assembly according to claim 1, wherein the extension portion is coupled to a plurality of areas of the repetition lever.

15. The support assembly according to claim 1, wherein a rib is arranged at a portion where the extension portion and the repetition lever are coupled.

16. A keyboard apparatus comprising:

a support assembly according to claim 1; and a key configured to rotate the support of the support assembly.

17. The keyboard apparatus according to claim 16, further comprising an output unit configured to output a sound signal generated according to a depression of the key.

18. The keyboard apparatus according to claim 17, wherein the output unit includes a speaker.

19. The keyboard apparatus according to claim 17, wherein the output unit includes a terminal.

20. The keyboard apparatus according to claim 16, further comprising a string generating a sound when hit by a hammer according to a depression of the key.

* * * * *